United States Patent [19]

Allen

[11] 4,332,234

[45] Jun. 1, 1982

[54] GUN SYSTEM WITH BARREL OPENING SEALED OFF BY PROJECTILE

[75] Inventor: Roger F. Allen, Bex, Switzerland

[73] Assignee: Plumettaz S.A., Bex, Switzerland

[21] Appl. No.: 249,335

[22] Filed: Mar. 30, 1981

[30] Foreign Application Priority Data

Apr. 11, 1980 [EP] European Pat. Off. ..... 80810123.2

[51] Int. Cl.[3] ..... F41F 1/04

[52] U.S. Cl. ..... 124/73; 441/85

[58] Field of Search ..... 124/31, 56, 57, 61, 124/69, 70, 71, 73, 74, 75, 77; 46/74 B; 406/192; 254/134.4; 182/50; 9/14

[56] References Cited

U.S. PATENT DOCUMENTS

| | | | |
|---|---|---|---|
| 314,298 | 3/1885 | Mefford | 124/73 |
| 381,901 | 5/1888 | Bartlett | 124/73 |
| 429,595 | 6/1890 | Bartlett | 124/73 |
| 433,674 | 8/1890 | D'Arcy-Irvine | 124/57 |
| 1,017,746 | 2/1912 | Glerum | 124/73 |
| 2,101,762 | 12/1937 | Straub | 124/71 |
| 2,960,977 | 11/1960 | Moorhead | 124/70 |
| 4,038,903 | 8/1977 | Wohlford | 89/8 |

FOREIGN PATENT DOCUMENTS

| | | | |
|---|---|---|---|
| 476718 | 3/1915 | France | 124/73 |
| 502561 | 2/1920 | France | 124/73 |
| 941917 | 9/1948 | France | 124/73 |

*Primary Examiner*—Richard T. Stouffer

*Attorney, Agent, or Firm*—Stevens, Davis, Miller & Mosher

[57] ABSTRACT

A cylindrical projectile is introduced into the barrel of the propelling apparatus in such a way that the base of the projectile is in contact with a rear cover plate of the breech block. An enclosure communicates with the barrel by means of an elbow and an opening in the side of the breech block to which the elbow is joined. When the projectile is in place, gaskets seal the barrel off from the enclosure. The latter may be filled with compressed air, e.g., by means of a coupling screwed into a tapped hole. It then suffices to move the projectile forward by pushing on a rod passing through the breech block cover plate. The thrust of the entering air moves the projectile, and the size of the air passage rapidly increases, thus ensuring a maximum propulsive effect.

9 Claims, 5 Drawing Figures

GUN SYSTEM WITH BARREL OPENING SEALED OFF BY PROJECTILE

This invention relates to gun systems, and more particularly to a gun system of the type comprising apparatus capable of propelling a useful load towards the place of its intended use and a projectile containing the useful load.

Gun systems of this type are used in numerous fields of human activity, e.g., for establishing a rope or cable connection between two separate locations such as a ship and a mooring facility ashore, or between the two sides of a valley. In such cases, the projectile fired by the apparatus is attached to a line which uncoils between the starting location and the destination as the projectile travels.

In another such system, the projectile is not only connected to the point of departure by a line but also contains a parachute designed to open at a predetermined moment as the projectile travels towards its destination. In the manner of a kite, the parachute keeps the end of the line at a certain altitude above the ground so that an instrument such as a radio transmitter can be hoisted up to the level thereof.

However, systems are also used in which the projectile carries a load useful for combating hail, for setting off avalanches, etc.

Most of the projectile-firing apparatus known at present utilizes a detonation to propel the projectile and consequently suffers from the drawbacks associated with the use of explosives: storage problems, the need for special precautions in installing, loading, and firing the apparatus, high costs, the risk of misfiring, and the danger of explosion.

In the field of small-caliber weapons, on the other hand, pistols, rifles, and machine-guns utilizing compressed air have been proposed, e.g., in U.S. Pat. No. 2,101,762 and in French Pat. No. 502,561. In these prior art guns, the barrel is connected by a tube containing a valve to a supply of air or another gas, under pressure. To fire the projectile, it is necessary to open this valve, which may be controlled by the trigger mechanism. The propellant gas then reaches the barrel, behind the projectile, through the aforementioned tube (cf. *Encyclopedia Americana,* 1976 ed., Vol. 1, p. 381, "Air Gun").

With the aim of remedying the drawbacks of gun systems utilizing explosive power for transporting a useful load, the use of compressed air for propelling the projectiles has already been envisaged. Until now, however, there has been an obstacle to the practical application of this idea, for since the projectiles are generally of a much larger caliber than those of air rifles or air pistols, the mass of air which must be displaced between the chamber and the inside of the barrel is quite considerable. It is therefore necessary to provide large-diameter valves and to open them extremely rapidly in order for the propulsive effect to develop without any drop in pressure. Owing to these restrictions, very voluminous tanks are used, and in certain cases complicated opening mechanisms are provided, the latter themselves requiring utilization of a secondary source of energy or one which is not totally reliable (cf. French Pat. Nos. 476,718 and 941,917 and U.S. Pat. No. 2,960,977).

It is an object of this invention to provide an improved gun system having a considerably simplified firing mechanism effective even for calibers of up to around ten centimeters, and making it possible to propel projectiles containing a useful load for a distance on the order of 300 to 400 meters, for example, without needing excessively voluminous compressed air tanks.

To this end, in the gun system according to the present invention, of the type initially mentioned, the improvement comprises an adjoining enclosure intended to contain compressed air, this enclosure communicating with the barrel via a lateral opening which is fluid-tightly closed by the projectile itself when the latter is in its firing position, and a firing mechanism by means of which the projectile may be displaced within the barrel by a distance sufficient to uncover the lateral opening.

Owing to this arrangement, communication between the tank and the launching barrel can be provided by an opening of very large area, so that at the moment of launching, the pressure of the gas contained in the tank is exerted upon the projectile immediately and without loss.

Preferred embodiments of the invention will now be described in detail with reference to the accompanying drawing. It should be understood, however, that other embodiments, which will also be mentioned below, are also possible although they are not shown.

Figure 1:
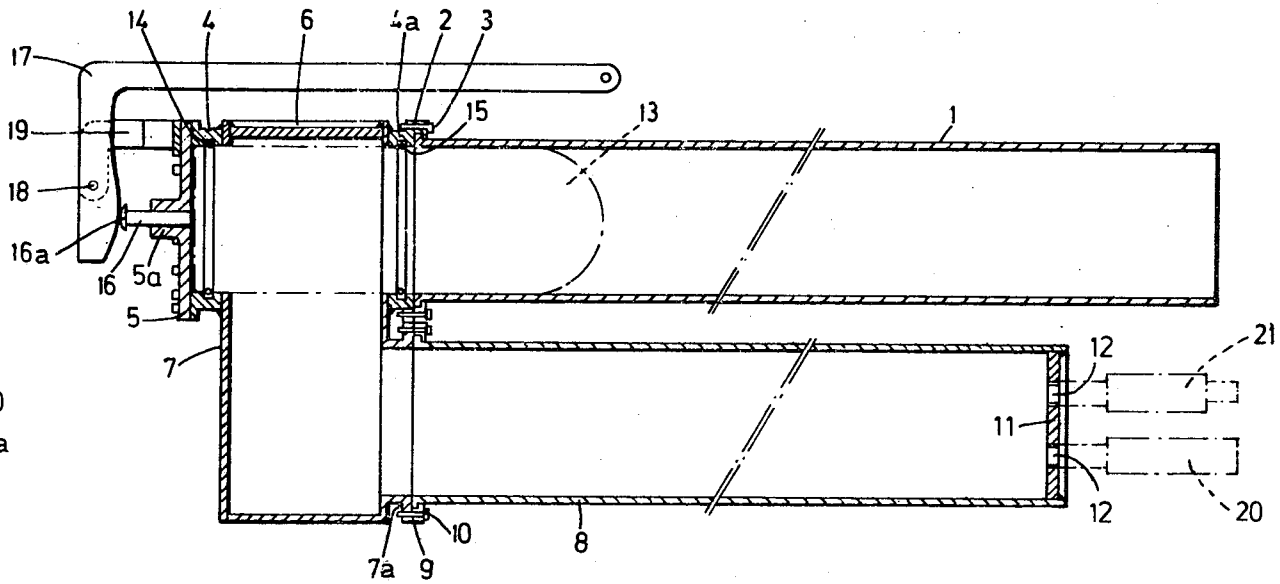
FIG. 1 is a longitudinal sectional view of the gun system to be described.
Figure 2:
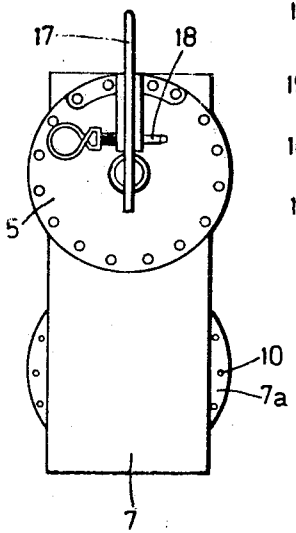
FIG. 2 is a rear elevation.

As will be seen, the construction of the projectile-firing apparatus of the gun system is extremely simple. A cylindrical tube 1, acting as a barrel, may be one meter long and 100 mm in diameter, for example. Tube 1, preferably metallic, is fixed by means of a retaining ring 2 and screws or bolts 3 to a tubular breech block 4 closed at the rear by a cover plate 5. In the embodiment illustrated, breech block 4 includes two diametrically opposed lateral openings, one of which is closed by a plate 6 arched to fit the shape of breech block 4, whereas the other leads into an elbow 7. Plate 6 and elbow 7 will preferably be welded to breech block 4. As may be seen in the drawing, elbow 7 ends in a flange **7*a* analogous to a flange 4*a* of breech block 4. A tubular auxiliary enclosure 8 is fixed to flange 7*a* by means of a fixing ring 9 and screws or bolts 10. Cylindrical enclosure 8 is closed at the front end thereof by a disk 11 welded to the wall of enclosure 8. In the embodiment illustrated, closure disk 11 includes two tapped holes 12, one of which receives a manometer 20 and the other a coupling equipped with a check valve 21. By means of this coupling, enclosure 8** can be filled with compressed air from a bottle or from the delivery pipe of a compressor.

Figure 3:
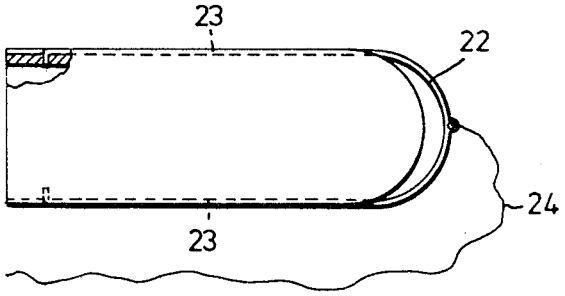
FIG. 3 is an elevation of the projectile.

Enclosure 8 will not be filled until a projectile 13, shown in dot-dash lines in FIG. 1, has been put into place. Projectile 13 has the shape of a cylindrical casing with a flat base and rounded head. This casing can open up in response to an appropriate control commmand in order to release the useful load it contains, which may vary greatly as to its nature depending upon the contemplated application. In certain cases, this load may be a parachute, for example. However, the projectile might also contain a hooking means, an alarm device, or any other kind of equipment. A line is connected at one end to projectile 13 and at the other end to the projectile-firing apparatus or its support. This line is not shown in the FIG. 1 inasmuch as such arrangements are already known. For instance, the projectile 13 may bear a shackle 22 (FIG. 3) having two arms fitted in longitudinal grooves 23 running along two opposite generatrices on the surface of the projectile. The ends of the shackle arms, bent at right angles, may then be hooked into holes in the wall of the projectile so that the shackle 22 can pivot about an axis perpendicular to the direction of travel of the projectile, after its start, so that the shackle swivels and the line 24 attached to the apex of the shackle is pulled along by the projectile from the rear (FIG. 3). The presence of such a shackle is of no hindrance at all when the projectile is being put in place, for as may be seen in the drawing, the projectile is muzzle-loaded, being introduced at the front of tube 1 and coming to rest against cover plate 5 of breech block 4.

When projectile 13 is in place, its sidewall compresses two sealing rings 14 and 15 seated in grooves in breech block 4. As a result, enclosure 8 can be filled with compressed air once projectile 13 is in place. The air accumulates in enclosure 8 and cannot escape since the opening by which enclosure 8 communicates with tube 1 is blocked by projectile 13 itself. In a reduction to practice, the dimensions being as indicated above, it was possible to fill the enclosure to a pressure of 80–100 bars.

In order to fire projectile 13, the apparatus illustrated further comprises a mechanism made up essentially of a rod 16 guided in a boss 5*a* of cover plate 5 and fitted within this passage so as to be virtually fluid-tight. By means of a lever 17, pivoted about a pin 18 which is mounted on a bracket 19 fixed to cover plate 5, rod 16 can be rapidly moved until its head 16*a* comes up against the end of center boss 5*a* of cover plate 5. During this movement, the inner end of rod 16 pushes projectile 13 far enough so that the base of the latter comes to be situated beyond gasket 14.

It is this movement which brings about the start of projectile 13, for as soon as gasket 14 no longer performs its sealing function, the compressed air in enclosure 8 can enter the space between cover plate 5 and the base of projectile 13. Even though the wiredrawing of the air at the beginning of its admission causes a drop in pressure, this effect is of brief duration, and a thrust is quickly exerted upon the base of projectile 13. As the latter begins to move under the influence of this thrust, the opening through which the compressed air is admitted becomes larger, so that any wiredrawing effect disappears. Thus, a maximum thrust force is developed owing to the pressure of the air in a much shorter time than anything it would be possible to achieve by operating a valve. Tests have shown that by the means just described, a projectile having a caliber of 100 mm could be accelerated in a barrel one meter long and reach a muzzle velocity sufficient to take it over a distance of several hundred meters. The volume required for enclosure 8 remains relatively small.

Neither the support for the projectile-firing apparatus nor the means for adjusting the elevation of tube 1 are shown in the drawing. These are conventional means well known to those skilled in the art and need not be described here.

Figure 4:
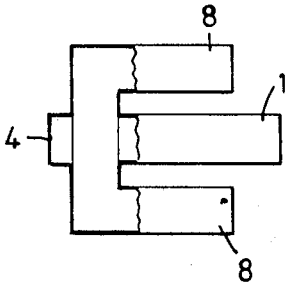
FIGS. 4 and 5 are schematic illustrations of two further embodiments.

Although the apparatus shown in FIG. 1 comprises only a single tubular tank 8 of a diameter approximately equal to that of tube 1, and disposed parallel thereto, provision might be made instead for several tanks of the same kind distributed around tube 1 and each communicating with breech block 4 by means of an opening and an elbow similar to elbow 7. Thus, for example, two or three tanks 8 might be provided around tube 1 (FIG. 4), whereby the reserve of pressurized gas provided for would be further increased.

Figure 5:
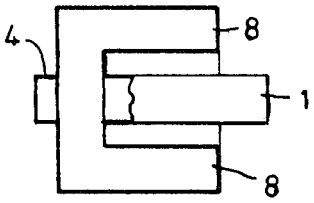

In still another embodiment, the enclosure might take the form of a receptacle 8 having two coaxial walls (FIG. 5), hence of annular shape, with the barrel 1 disposed in the middle of the enclosure. In this case, the breech block might be composed of two completely separate parts, and the opening provided for supplying the barrel with compressed air at the start of propulsion might extend around the whole periphery of the projectile.

What is claimed is:

1. A gun system of the type comprising apparatus capable of propelling a useful load towards its place of intended use and a projectile for holding said useful load, said apparatus including a barrel having a sidewall, wherein the improvement comprises:

an enclosure disposed adjacent to said barrel and designed to contain compressed air at full pressure prior to the firing of the projectile, at least one opening made in said sidewall of said barrel, said enclosure communicating with said barrel through said opening, and said opening being sealed off by said projectile when said projectile is in firing position and substantially the full pressure of the compressed air in said enclosure is bearing against the side of said projectile, and a firing mechanism, powered by a second mechanism independent of the compressed air in said enclosure, capable of moving said projectile within said barrel by a distance sufficient to uncover said opening whereupon said full pressure substantially immediately bears upon said projectile at the rear thereof to fire the same.

2. The gun system of claim 1, wherein said enclosure comprises two or more elongated tanks disposed about said barrel, each of said tanks including a said opening.

3. The gun system of claim 1, wherein said enclosure takes the form of a ring surrounding said barrel.

4. The gun system of claim 3, wherein said barrel is completely interrupted over part of the length thereof in the vicinity of the breech end thereof in order to communicate with said enclosure around the entire periphery of said barrel.

5. The gun system of any one of claims 1 to 4, wherein said enclosure comprises at least one coupling provided with a check valve.

6. The gun system of claim 1, wherein said barrel includes two grooves made in the inside wall thereof on either side of said opening, said apparatus further comprising two sealing rings respectively disposed in said grooves coaxially with said barrel, said sealing rings cooperating with the sidewall of said projectile for sealing off said opening.

7. The gun system of claim 1, wherein said apparatus further comprises a cover plate closing the breech end of said barrel, said firing mechanism comprising a rod passing slidingly and substantially fluid-tightly through said cover plate and said second mechanism comprising means for imparting an axial sliding movement to said rod and thence to said projectile.

8. The gun system of claim 1, wherein said projectile comprises a line fixed thereto and extending outside said barrel, said line being arranged to uncoil in space as said projectile is propelled.

9. The gun system of claim 1, wherein said projectile includes means for causing it to open automatically in order to release said useful load.

* * * * *